United States Patent [19]

Schmid et al.

[11] Patent Number: 4,954,283

[45] Date of Patent: Sep. 4, 1990

[54] POLYETHYLENE GLYCOL ETHER LOW TEMPERATURE FOAM SUPPRESSING AGENTS IN LOW-FOAM CLEANING AGENTS

[75] Inventors: Karl H. Schmid, Mettmann; Alfred Meffert, Monheim; Gilbert Schenker, Erkrath; Adolf Asbeck, Duesseldorf; Rolf Scharf, Monheim, all of Fed. Rep. of Germany

[73] Assignee: Henkel Kommanditgesellschaft auf Aktien, Duesseldorf, Fed. Rep. of Germany

[21] Appl. No.: 295,872

[22] Filed: Jan. 11, 1989

[30] Foreign Application Priority Data

Jan. 11, 1988 [DE] Fed. Rep. of Germany ..... 3800493

[51] Int. Cl.[5] ..... C11D 3/075; C11D 1/72

[52] U.S. Cl. ..... 252/135; 252/156; 252/174.16; 252/174.24; 252/174.21; 252/174.22

[58] Field of Search ..... 252/135, 156, 174.21, 252/174.22, 321

[56] References Cited

U.S. PATENT DOCUMENTS

| | | | |
|---|---|---|---|
| 4,522,740 | 6/1985 | Schmid et al. | 252/174.21 |
| 4,600,523 | 7/1986 | Piorr et al. | 252/174.22 |
| 4,780,237 | 10/1988 | Schmid et al. | 252/174.22 |
| 4,797,222 | 1/1989 | Hoefer et al. | 252/174.21 |
| 4,836,951 | 6/1989 | Totten et al. | 252/174.21 |

*Primary Examiner*—Prince E. Willis

*Attorney, Agent, or Firm*—Ernest G. Szoke; Wayne C. Jaeschke; Daniel S. Ortiz

[57] ABSTRACT

The invention is cleaning compositions containing Polyethylene-glycol ethers of the formula $$R_1—(CH_2CH_2O)_n—R_2 \quad (1)$$

in which $R_1$ is a straight-chain or branched alkyl- or alkenyl radical having from 20 to 28 carbon atoms $R_2$ is an alkyl radical having from 4 to 8 carbon atoms and n is an integer from about 6 to about 20 as a foam-suppressing additive. The cleaning compositions are stable over a broad temperature range and having low foaming characteristics particularly at about ambient temperatures.

22 Claims, No Drawings

POLYETHYLENE GLYCOL ETHER LOW TEMPERATURE FOAM SUPPRESSING AGENTS IN LOW-FOAM CLEANING AGENTS

BACKGROUND OF THE INVENTION 1. Field of the Invention

The invention is the use of terminally blocked polyethylene-glycol ethers as foam suppressing additives in low-foam cleaning agents. The invention makes available foam suppressing agents which combine high effectiveness with low toxicity and biodegradability. The agents of the invention are suitable for effectively suppressing foam formation in cleaning processes such as spray cleaning, in the low temperature range, particularly in the range of ambient temperature.

Aqueous cleaning agents intended for use in industry, in particular those for cleaning metal, glass, and ceramic surfaces, usually contain substances which are capable of counteracting formation of foam. The use of foam-suppressing additives is required because the impurities which are loosened from the substrates and which collect in the cleaning baths act as foaming agents. In addition, the use of foam suppressing agents may also be necessary because the cleaning agent themselves contain constituents, which form foam, under the prescribed operating conditions. As an example, the anionic tensides which are used to a great extent in cleaning agents tend to produce foam.

2. State of Related Art

Addition products of alkylene oxides to organic compounds with reactive hydrogen atoms in the molecule have been used as foam reducing agents. Addition products of propylene oxide to aliphatic polyalcohols—see the example DE-PS 1 280 455 and DE-PS 1 621 592—and in aliphatic polyamines—cf. for example DE-PS 1 289 597 and DE-PS 1 621 593—as well as addition products of ethyleneoxide and propyleneoxide to aliphatic polyamines, particularly ethylenediame—cf. DE-PS 1 944 569 have in particular proved useful in practice. These alkylene oxide addition products, possess in addition to good foam reducing properties, the alkali stability generally required for use in commercial and industrial cleaning compositions. The compounds of this class are however not sufficiently biodegradable to satisfy current legal regulations.

A class of highly effective and at the same time biodegradable antifoam agents is described in DE-OS 33 15 951. The use of terminally blocked polyethylene glycol ethers of the formula (1) $R_1O—(CH_2CH_2O)_n—R_2$ is described, wherein $R_1$ is a straight-chain or branched alkyl or alkenyl radical with from 8 to 18 carbon atoms, $R_2$ is an alkyl radical with from 4 to 8 carbon atoms and n is an integer of from 7 to 12. In practice a composition which has proven particularly useful is a compound in which $R_1$ is a fatty alcohol radical with from 12 to 18 carbon atoms, $R_2$ is an n-butyl radical, and n is 10.

The present invention is based on the unexpected discovery that varying the terminal end-group fatty alcohol, polyethylene glycol ether structures provides more effective foam-suppressing agents. With the method according to the invention, it is possible to increase the effectiveness while retaining the low toxicity and biodegradability of the foam suppressing additives. The ethylene glycol ethers of the present invention provide improved effectiveness in the low temperature range, for example in the ambient temperature range or at slightly higher temperatures.

The discovery is unexpected in comparison with previously known anti-foam agents. It is known, that in commercial cleaning processes rinsing processes are frequently carried out at low temperatures, in order, to carry out energy-saving precleaning. Conventional foam-suppressing additives generally suppress foam effectively in a temperature range above about 50° C., however, their use at a temperature of about 20° C. provides a comparatively weaker foam-suppressing effect. Unexpectedly the additives according to the invention are particularly effective at low temperatures and suppress foam when they are blended with previously used components of similar structure.

BRIEF DESCRIPTION OF THE INVENTION

Other than in the operating examples, or where otherwise indicated, all numbers expressing quantities of ingredients or reaction conditions used herein are to be understood as modified in all instances by the term "about".

The inventions is a method of suppressing foam by use of polyethylene glycol ethers of the formula (1)

$$R_1O—(CH_2CH_2O)_n—R_2 \quad (1)$$

wherein $R_1$ is a straight or branched chain alkyl or alkenyl radical with from 20 to 28 carbon atoms.

$R_2$ is an alkyl radical with from 4 to 8 carbon atoms and n is an integer of from 6 to 20, in low-foam cleaning compositions and cleaning compositions containing the polyethylene glycols of formula (1).

The preferred compounds of the formula (1) contain a radical $R_1$ with from 20 to 24 carbon atoms. Branched radicals are particularly preferred. In the compounds according to the invention the preferred radical $R_2$ is the butyl radical and particularly the n-butyl radical. The preferred values for n in the general formula (1) lie between 6 and 12.

DETAILED DESCRIPTION OF THE INVENTION

The critical modification according to the invention of the polyethylene glycol ethers of the general formula (1), in comparison with the compounds of similar structure in the previously mentioned DE-OS 33 15 951, lies in the variation of the radical $R_1$. According to the invention the carbon number of this radical is increased compared with the radical previously described, and amounts to at least, 20 carbon atoms. Fatty alcohols, of natural origin of this type, can be obtained in a manner known per se by hydrogenation of higher fatty acid mixtures or of the methyl esters. The class of Guerbet alcohols is in particular useful in the invention. Alcohols of this type are prepared by the condensation of fatty alcohols with a lower carbon number, in the presence of an alkali, e.g. potassium hydroxide or potassium alcoholate. The reaction proceeds, for example, at temperatures from 200 to 300° C. and provides branched Guerbet alcohols, which have branching at the second carbon from the hydroxyl group. Selected fatty alcohols or mixtures of fatty alcohols can be used to prepare the alcohol mixture with a higher carbon number. The mixture produced by the process has a complex composition.

Alcohols such as 2-octyl-dodecanol-1 and 2-decyl-tetradecanol-1 or their mixtures, can be used as the starting materials for the production of polyglycol ethers of formula (1).

The production of the fatty alcohol terminally blocked polyglycol ethers of the formula (1) is disclosed in DE-OS 33 15 951 which is incorporated herein by reference. One reacts the fatty alcohols having a high carbon number described above, with ethylene oxide in the mole ratio of 1:6 to 1: 20 and the hydroxyl group present in the reaction product is etherified. The reaction with ethylene oxide is carried out under known alkoxylation conditions, preferably in the presence of suitable alkaline catalysts. The etherification of the free hydroxyl group is preferably carried out under the known conditions of Williamson's ether synthesis with straight-chain or branched $C_4$ to $C_8$-alkyl halides. The n-butyl radical has particular importance within the framework of the process according to the invention for the radical $R_2$ of the formula (1). Examples for suitable alkyl halides in such a concluding etherification are accordingly n-butyl halides, such as n-butyl iodide. The invention is not however, limited to these, further examples are sec.-butyl bromide, tert.-butyl chloride, amyl chloride, tert.-amyl bromide, n-hexyl chloride, n-heptyl bromide and n-octyl chloride.

It is preferred in preparation of the compositions useful in the present invention, to use alkyl halides and alkali in stoichiometric excess, for example from 10 to 50%, over the hydroxyl groups, which are to be etherified.

In a preferred embodiment of the invention polyglycol ethers of the formula (1) are used, in which n is an integer from 6 to 12.

The terminally blocked polyglycol ethers of the formula (1) are preferably used, according to the invention, in admixture with structurally similar polyethylene glycol ethers of the formula $R_3(CH_2CH_2O)_mR_4$ in which the radical $R_3$ represents a straight-chain or branched alkyl or alkenyl radical with from 8 to 18 C-atoms, $R_4$ is an alkyl radical having from about 4 to about 8 carbon atoms, and m is an integer from 7 to 12, and preferably from 8 to 10. In this preferred embodiment the invention dilutes the here newly described longer-chain polyglycol ethers with the radical $R_1$ with the foamsuppressing additives from DE-OS 33 15 951. Mixing ratios of both types in the range of 1 to 9 to 9 to 1 by weight, particularly ratios of 6 to 4 to 4 to 6 by weight are useful in this embodiment.

The terminally blocked polyglycol ethers of the formula (1) according to the invention provide high alkali and acid stability. Their foam-suppressing effect in alkaline and neutral cleaning solutions is unexpectedly increased and they fulfill the legal requirements of biodegradability.

The cleaning compositions in which the terminally blocked polyglycol ethers of the invention are used, can contain the usual constituents such as wetting agents, builders and complexing agents, alkalis or acids, corrosion inhibitors and also in some cases organic solvents.

As wetting agents, nonionic surfactant compounds such as polyglycol ethers, which are obtained by the addition of ethylene oxide to alcohols, in particular to fatty alcohols, alkyl phenols, fatty amines and carboxylic acid amides are useful. The surfactant compounds such as alkali-metal, amineand alkylol amine salts of fatty acids, alkyl sulphuric acids, alkyl sulphonic acids and alkyl benzenesulphonic acids are also useful in the cleaning composition.

As builders and complexing agents the cleaning compositions can contain alkali-metal-orthophosphate, polymeric phosphates, -silicates, -borates, -carbonates, polyacrylates and -gluconates as well as citric acid, nitrilotriacetic acid, ethylene diamine tetraacetic acid, 1-hydroxyalkane-1, 1-diphosphonic acids and ethylene diamine- tetra-(methylene phosphonic acid), posphonoalkane polycarboxylic acids, such as, for example, phosphonobutane tri-carboxylic acid and alkali metal salts of these acids. Highly alkaline cleaning compositions, in particular bottle cleaning compositions, contain substantial amounts of caustic alkali in the form of sodium hydroxide and/or potassium hydroxide. If specific cleaning effects are desired, the cleaning agents can contain organic solvents, for example alcohols, benzine fractions and chlorinated hydrocarbons as well as free alkylol amines.

In connection with the invention, a "cleaning composition" is understood to include aqueous solutions intended for direct application to the substrate to be cleaned and the concentrates and solid mixtures intended for dilution to form the aqueous solution for direct application to the substrate.

The ready-for-use solutions can range from acid to strongly alkaline; they are usually used in the temperature range from 20° to 90° C.

The terminally blocked polyglycol ethers used in the method of the invention, produce efficient effects even in small concentrations. They are preferably added in such quantities that their concentration is from 50 to 500 ppm in the ready-for-use solutions.

EXAMPLES

The following examples illustrate the foam suppressing effect of the additives according to the invention in comparison with structurally similar additives which do not fall within the framework of the invention according to a test method, which can be described as follows:

In a double-walled 2 liter measuring cylinder 300 ml of a 1% by weight aqueous solution of caustic soda is adjusted to 20° or 65° C. The foam-suppressing additive is added in the quantities give below. Using a laboratory tube pump the liquid is pumped around at a circulation rate of 4 liters per minute. The test solution is drawn out approx. 5 mm above the bottom of the measuring cylinder by means of a glass tube 55 cm long (inner diameter 8.5 mm, outer diameter 11 mm), which is connected to the pump by a silicon tube, and returned in free-fall via a second glass tube (length 20 cm), which is attached at the 2000 ml mark of the measuring cylinder.

After 30 seconds, 1 ml of a 1% by weight aqueous solution of the tri-ethanolamine salt of tetrapropylene benzol sulphonate (referred to in the following tables as "test foam-former") is measured into the liquid and after a further 30 seconds the volume of liquid and foam, is measured. At intervals of 1 minute, further test foam-former is added in 1 ml portions and the volume of liquid and foam arising measured. This step-by-step addition of the test foam-former and determination of the volume after 30 seconds is continued until the tenside solution in the measuring cylinder has foamed up to 2000 ml.

EXAMPLE 1

A foam-suppressing additive, A according to the invention was added at 20° C. and 65° C. respectively and the foam-suppressing effect was compared with additives of the prior art (products B and C). The foam-suppressing additives A to C were used in the given test methods each in quantities of 0.1 ml of pure substance.

The products A to C used here were the following:

Products

According to the invention
A 2-octyldodecanol-8 EO -n-butyl
Comparison
B 2-hexyldecanol-6 EO-n-butylether
C Coconut alcohol-10 EO-n-butylether The values measured in the comparative experiments are summarized in the following table 1.

TABLE 1

| Milliliters Test Foam-Former | Product A | | Product B | | Product C | |
|---|---|---|---|---|---|---|
| | 20° C. | 65° C. | 20° C. | 65° C. | 20° C. | 65° C. |
| 0 | 300 | 300 | 320 | 300 | 400 | 300 |
| 1 | 300 | 300 | 320 | 300 | 460 | 320 |
| 2 | 300 | 300 | 340 | 300 | 580 | 340 |
| 3 | 300 | 300 | 380 | 300 | 680 | 360 |
| 4 | 340 | 300 | 440 | 300 | 800 | 400 |
| 5 | 380 | 300 | 460 | 320 | 1000 | 420 |
| 6 | 400 | 320 | 480 | 420 | 1400 | 440 |
| 7 | 420 | 400 | 520 | 460 | 1600 | 460 |
| 8 | 420 | 460 | 540 | 520 | 1820 | 540 |
| 9 | 460 | 520 | 600 | 600 | 2000 | 780 |
| 10 | 480 | 620 | 700 | 660 | | 940 |
| 11 | 500 | 760 | 840 | 760 | | 1240 |
| 12 | 540 | 860 | 1100 | 820 | | 1760 |
| 13 | 580 | 1000 | 1280 | 1100 | | 1880 |
| 14 | 600 | 1100 | 1500 | 1180 | | 1940 |
| 15 | 660 | 1220 | 1700 | 1240 | | 2000 |
| 16 | 720 | 1480 | 1880. | 1320 | | |
| 17 | 800 | 1620 | 2000 | 1480 | | |
| 18 | 1000 | 1760 | | 1660 | | |
| 19 | 1300 | 1860 | | 1820 | | |
| 20 | 1680 | 2000 | | 2000 | | |
| 21 | 2000 | | | | | |

EXAMPLE 2

2 bottle-cleaning formulations of the compound given below in table 2 were tested according to the given test method. The first of the two formulation contained as the foam-reducing additive exclusively the previously mentioned product C of the prior art. The second formulation used a mixture of the foam-suppressing additive A in admixture with Product C according to the prior art following the process according to the invention.

The following table 2 summarizes the values recorded. It shows moreover a further advantage of the compositions of the invention.

The bottle-cleaning formulation according to the invention is stable in storage in the liquid phase at temperatures under 0° C.

TABLE 2

| | |
|---|---|
| 40.0 by wt. % phosphoric acid (85%) | 40.0 by wt. % phosphoric acid (85%) |
| 20.0 by wt. % product C | 10.0 by wt. % product C |
| 1.0 by wt. % solution aid | 1.0 by wt % solution aid |
| 39.0 by wt. % de-ionized water | 39.0 by wt. % de-ionized water |
| | 10.0 by weight % Product A |

Storage Conditions

| | | |
|---|---|---|
| stable between −10 | stable between 0° C. and 50° C. | stable between −10° C. and +50° C. |

TABLE 2-continued

| |
|---|
| and +50° C. |

FOAM INHIBITION
(Free Fall Circulation Method)

| Milliliters Test Foam Former | Total Volume Milliliters 20° C. | 65° C. | 20° C. | 65° C. |
|---|---|---|---|---|
| | C | | A + C | |
| 0 | 320 | 300 | 300 | 300 |
| 1 | 320 | 300 | 300 | 300 |
| 2 | 320 | 300 | 320 | 300 |
| 3 | 360 | 300 | 360 | 300 |
| 4 | 420 | 300 | 400 | 300 |
| 5 | 600 | 320 | 400 | 300 |
| 6 | 780 | 340 | 420 | 380 |
| 7 | 940 | 400 | 420 | 460 |
| 8 | 1100 | 420 | 460 | 520 |
| 9 | 1260 | 460 | 480 | 580 |
| 10 | 1700 | 500 | 500 | 640 |
| 11 | 2000 | 540 | 500 | 800 |
| 12 | | 740 | 520 | 960 |
| 13 | | 1200 | 520 | 1000 |
| 14 | | 1600 | 520 | 1060 |
| 15 | | 2000 | 540 | 1140 |
| 16 | | | 560 | 1280 |
| 17 | | | 580 | 1380 |
| 18 | | | 600 | 1520 |
| 19 | | | 600 | 1700 |
| 20 | | | 640 | 1860 |
| 21 | | | 640 | 2000 |
| 22 | | | 660 | |
| 23 | | | 700 | |
| 24 | | | 780 | |
| | | | Breaking off point | |

We claim:

1. A low foam cleaning composition which comprises:

a foam suppressing amount of at least one polyethylene-glycol ether of the formula:

$$R_1O—(CH_2CH_2O)_n—R_2 \quad (1)$$

wherein, $R_1$ is a straight-chain or branched alkyl- or alkenyl radical having from 20 to 28 carbon atoms, $R_2$ is an alkyl radical having from 4 to 8 carbon atoms and n is an integer from about 6 to about 20 ; and at least one composition selected from the group consisting of nonionic surfactants, anionic surfactants, alkali metal hydroxide, builders, complexing agents, alkali metal phosphates, alkali metal silicates, alkali metal borates, alkali metal carbonates, polyacrylates, phosphonic acid and organic solvents.

2. A composition of claim 1 wherein $R_1$ has 20 to 24 carbon atoms $R_2$ is a butyl radical and n is from about 6 to about 2.

3. A composition of claim 2 wherein $R_1$ is a branched radical.

4. A composition of claim 2 wherein $R_2$ is n-butyl.

5. A composition of claim 2 wherein $R_1$ is a branched chain radical and $R_2$ is n-butyl.

6. A low foam cleaning composition which contains a mixture comprising:

(a) at least one polyethylene glycol ether of the formula:

$$R_1O(CH_2CH_2O)_nR_2 \quad (1)$$

wherein, $R_1$ is a straight chain or branched alkyl or alkenyl radical having from 20 to 28 carbon atoms, $R_2$ is an alkyl radical having from 4 to 8 carbon atoms, and n is an integer of from about 6 to about 20; and (b) at least one polyethylene glycol ether of the formula $$R_3O(CH_2CH_2O)_mR_4 \quad (2)$$

wherein $R_3$ is straight chain or branched alkyl or alkenyl radical having from 8 to 18 carbon atoms $R_4$ is an alkyl radical having from 4 to about 8 carbon atoms and m is an integer of from about 7 to about 12, wherein the mixture of polyethylene glycol ethers is present in an amount to provide a foam suppressing effect.

7. A ready to use composition of claim 1 containing from about 50 to 500 parts per million of the polyglycol ethers of claim 1.

8. A ready to use composition of claim 6 containing from about 50 to 500 parts per million of the mixture of polyethylene glycols of claim 6.

9. A low foam cleaning composition of claim 1 containing at least one composition selected from the group consisting of citric acid, ethylene diamine tetracetic acid, ethylene diamine tetra (methylene phosphonic acid), phophonoalkane polycarboxylic acid and alkali metal salts of the acids.

10. A composition of claim 1 which suppresses foam at a temperature in the range of about 20° C.

11. A method for suppressing foam of a cleaning composition which comprises adding to the cleaning composition a foam suppressing amount of a polyethylene glycol of the formula $$R_1O(CH_2CH_2O)_nR_2 \quad (1)$$

wherein $R_1$, $R_2$ and n are as defined above.

12. A method of suppressing foam of a cleaning composition of claim 11 wherein the polyethylene glycol of formula (1) is present in the composition to provide from about 50 to about 500 parts per million in a ready to use composition.

13. A method of suppressing foam of a cleaning composition which comprises adding to the cleaning composition a foam suppressing amount of a mixture of polyethylene glycol ethers of the formula (a) $R_1O(CH_2CH_2O)_nR_2$, and (b) $R_3O(CH_2CH_2O)_mR_4$ (2)

wherein $R_1$, $R_2$, $R_3$, $R_4$, m and n are as defined above.

14. A method of claim 13 wherein the ratio of (a) to (b) in the mixture is from about 1:9 to about 9:1.

15. A method of claim 13 wherein the mixture of polyethylene glycol ethers is added to the cleaning composition in an amount sufficient to provide from about 50 parts per million to about 500 parts per million in the cleaning composition ready for use.

16. A method of claim 15 wherein the ratio by weight of (a) to (b) in the mixture is from abut 1:9 to about 9:1.

17. A composition of claim 6 wherein the ratio of by weight of (a) to (b) is from about 1:9...to about 9:1.

18. A composition of claim 17 wherein the ratio by weight (a) to (b) is from about 4:6 to about 6:4.

19. A method of claim 14 wherein the ratio by weight of (a) to (b) is from about 4:6 to about 6:4.

20. A method of claim 16 wherein the ratio by weight of (a) to (b) is from about 4:6 to about 6:4.

21. A composition of claim 8 wherein the ratio of (a) to (b) is from about 1:9 to about 9:1.

22. A composition of claim 21 wherein the ratio of (a) to (b) is from about 4:6 to about 6:4.

* * * * *